US005784766A

United States Patent [19]

Downie et al.

[11] Patent Number: 5,784,766

[45] Date of Patent: Jul. 28, 1998

[54] BUCKLE MECHANISM

[75] Inventors: Andrew John Downie; David Burke, both of Carlisle, United Kingdom

[73] Assignee: AlliedSignal Inc., Morristown, N.J.

[21] Appl. No.: 737,367

[22] PCT Filed: May 10, 1995

[86] PCT No.: PCT/GB95/01065

§ 371 Date: Apr. 14, 1997

§ 102(e) Date: Apr. 14, 1997

[87] PCT Pub. No.: WO95/30347

PCT Pub. Date: Nov. 16, 1995

[30] Foreign Application Priority Data

May 10, 1994 [GB] United Kingdom ..... 9409246

[51] Int. Cl.[6] ..... A44B 11/00

[52] U.S. Cl. ..... 24/641; 24/643; 24/644

[58] Field of Search ..... 24/641, 643, 644, 24/633, 653

[56] References Cited

U.S. PATENT DOCUMENTS

| | | | |
|---|---|---|---|
| 4,393,557 | 7/1983 | Schmidt | 24/643 |
| 5,014,401 | 5/1991 | Kitazawa | 24/641 |

FOREIGN PATENT DOCUMENTS

| | | |
|---|---|---|
| 0071613 | 2/1983 | European Pat. Off. . |
| 0559403 | 9/1993 | European Pat. Off. . |
| 0402839 | 12/1996 | European Pat. Off. . |
| 3731997 | 4/1989 | Germany . |
| 2 104 141 | 3/1983 | United Kingdom . |
| 2 195 140 | 3/1988 | United Kingdom . |
| 2 242 479 | 10/1991 | United Kingdom . |
| 2 267 533 | 12/1993 | United Kingdom . |
| 2 271 377 | 4/1994 | United Kingdom . |
| 92/15216 | 9/1992 | WIPO . |

*Primary Examiner*—Victor N. Sakran
*Attorney, Agent, or Firm*—Markell Seitzman

[57] ABSTRACT

A buckle mechanism for use in vehicle safety restraint systems which is substantially shock proof against forces in many directions in a crash situation and also against forces generated by buckle pretensioners used to take up the slack in the belt webbing.

The buckle mechanism has a movable button and a resiliently biased locking member guided by a rocking support member and movable transversely to the plane of movement of the button to engage or disengage a locking surface of a co-operating tongue. Mutually co-operating abutments are provided respectively on the button and on the locking member or on the rocking support member to lock the button against the buckle disengaging forces of a crash situation. Preferably an overlocking member is also provided to further resist spurious disengagement of the buckle.

16 Claims, 10 Drawing Sheets

BUCKLE MECHANISM

DESCRIPTION

The present invention relates to a buckle mechanism, particularly to a buckle mechanism for use in vehicle safety restraint systems.

Government safety regulations and strict standards laid down by vehicle manufacturers require such buckles to engage easily, securely, reliably and without error, to restrain a vehicle occupant throughout a variety of crash situations and to be easily and positively releasable when required.

There are a variety of known buckle mechanisms. For example in which a pivoting locking member engages a slot in a cooperating tongue attached to a safety restraint belt, and is disengaged by means of a button on the buckle housing.

Springs are provided to bias parts of the buckle in appropriate directions, e.g. to avoid spurious release and to retain the tongue securely.

Such buckle has a good latching and release mechanism but requires many parts in its construction making it expensive to manufacture and introducing more potential for unreliability.

A recent requirement of some vehicle manufacturers is that a buckle be shock proof. This is particularly important when pretensioners are used in cars to take up excess slack in a restraining belt when a crash situation is detected. The pretensioner may be arranged to take up the slack either at the retractor end of the belt or at the buckle end. When it is fitted to the buckle end, the buckle mechanism is typically pulled back to take up the slack at a force of up to 6000 g and such a force has been known to release the buckle mechanism due to the inertia of the buckle button.

To avoid this situation, it is known to counterbalance the mass of the button. However, this has not been found to produce the reliable results required in safety restraint systems.

According to a first aspect of the present invention, there is provided a buckle mechanism comprising a movable button member, and locking means movable transversely to the plans of movement of the button to engage or disengage a locking surface of a cooperating tongue wherein mutually cooperating abutments are provided respectively on the button member and on the locking means to lock the button against forces tending to move the locking means to a position of disengagement.

The locking means is preferably resiliently biased, for example by means of a leaf spring, into locking engagement with the tongue. It may comprise a locking member guided by a rocking support member on which one of the abutments is provided.

Preferably an overlocking member is provided resiliently biased in the tongue withdrawal direction but slidably mounted to overcome the resilient bias in the event of crash inertia forces and having at least one overlocking surface to block movement of the locking member out of engagement with the tongue in a crash situation.

It will be seen that the provision of the cooperating abutments serves to avoid disengagement of the buckle mechanism of the invention during pretensioning while the overlocking member prevents disengagement at the end of the pretensioning operation, i.e. prevents the negative g forces from having an effect.

Additionally, the buckle of the present invention avoids spurious release in the event of shock from side impacts since the cooperating abutments even then hold the button in place, and the overlocking surface further prevents sideways movement of the locking member in the event of a shock.

Previously known buckle mechanisms, including compensating mass systems cannot prevent spurious release in such a variety of directions.

Preferably the button member has a ramp surface to effect disengagement of the buckle and it comprises three parts of different gradients. The part closest to the locking member has a gradient of between 40° and 60° relative to the plane of the tongue, more preferably between 45° and 55° and most preferably of about 50°. It is found that this angle best resists spurious release of the buckle yet provides for an easy enough unbuckling operation for example for women and children to accomplish without undue effort, and yet requires enough effort to guard against false locking or mis latching the sleep gradient encourages a quick release of the locking member, when the button is depressed.

The second part of the ramp surface is preferably at a 15° to 25° angle to the plane of the tongue, more preferably around 20°. This surface takes the release loads in lifting the locking member.

The third part of the ramp surface is preferably again around 40°–60°, more preferably 50°.

Preferably the button ramp is spaced from the locking member, in the normal button state, e.g. by about 3 mm.

False latching of a tongue in a buckle is contributed to by the balance between the ejector spring and the resilient strength of the means biasing the locking member into engagement with the tongue. In preferred embodiments of the present invention, this is balanced to substantially avoid false latching.

The resilient bias of the locking member is preferably provided by a leaf spring which may suitably be three pronged.

According to a particularly preferred embodiment, the pivot point of the rocking support is arranged to be in a plane spaced from the tongue insertion plane and at a position arranged with regard to the centre of gravity of the buckle mechanism parts so as to further reduce inertial effects of the buckle components and thus reduce the possibility of spurious release in a shock situation.

For a better understanding of the present invention and to show how the same may be carried into effect, reference will now be made to the accompanying drawings in which.

Figure 1:
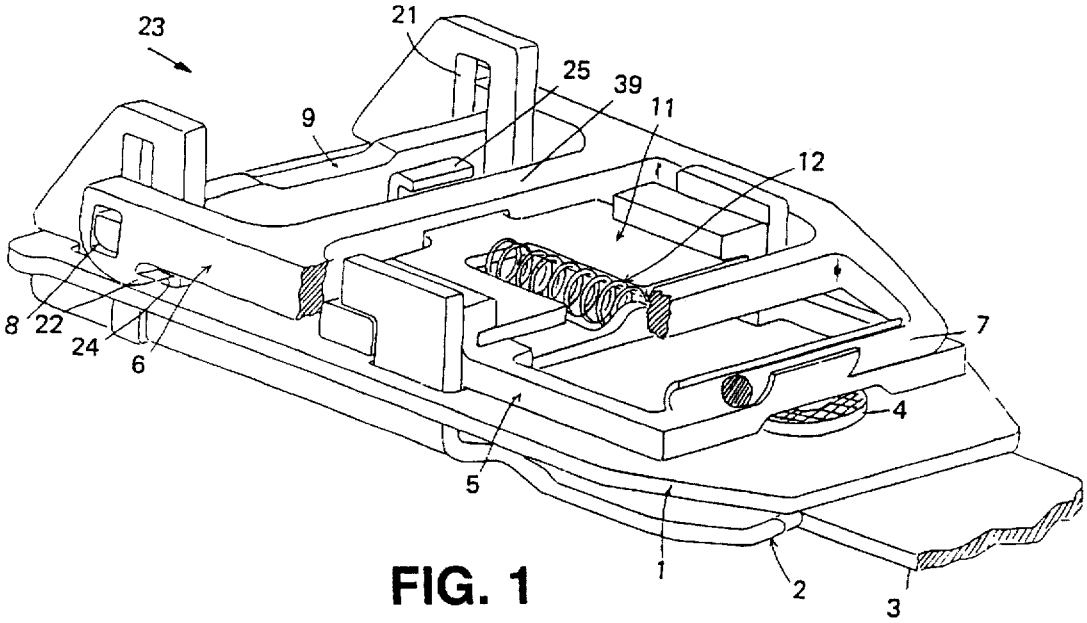
FIG. 1 is a perspective part cut away view of part of a buckle mechanism according to the present invention.
Figure 6A:
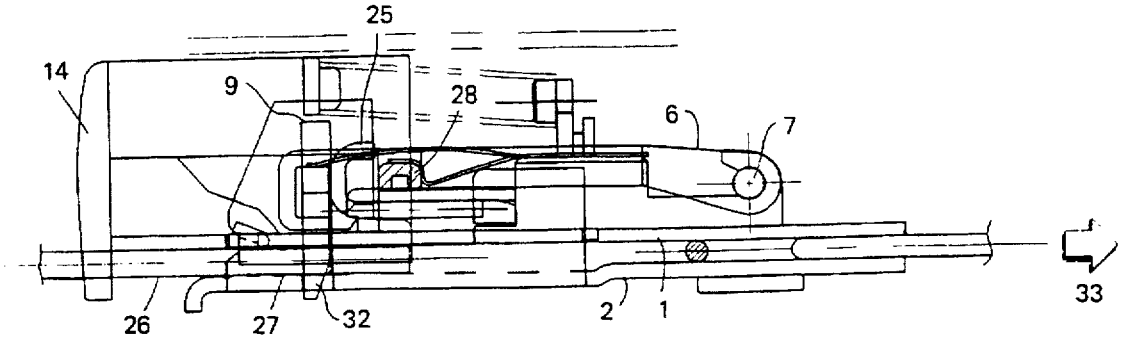
Figure 6B:
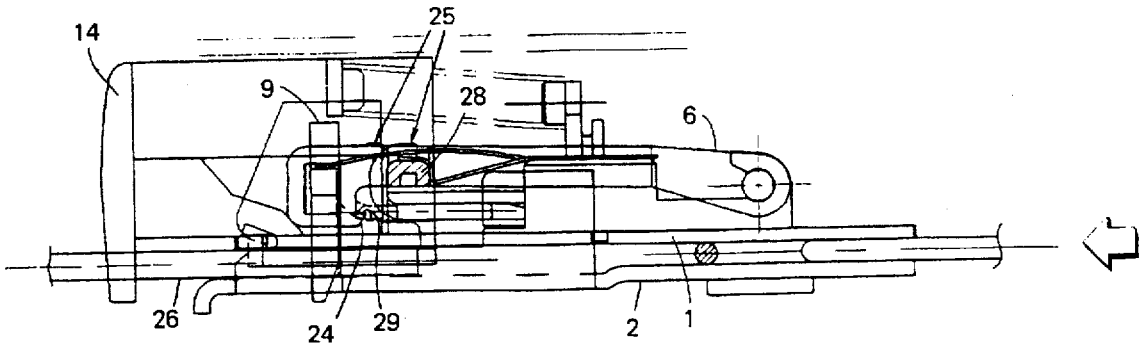
Figure 6C:
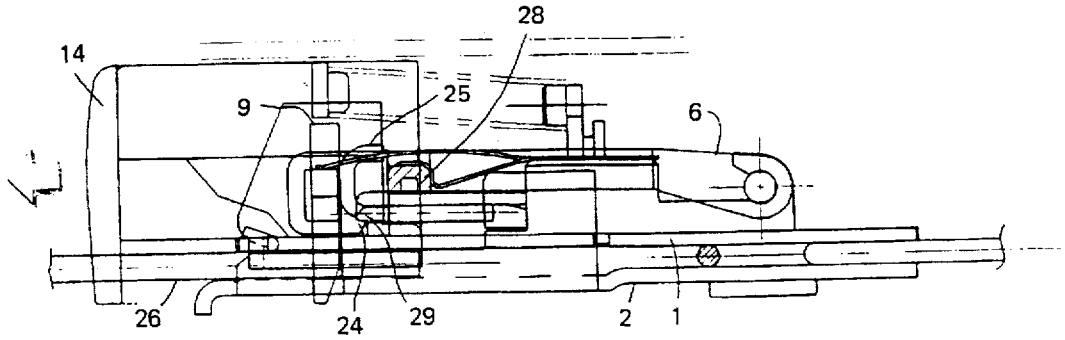
Figure 7B:
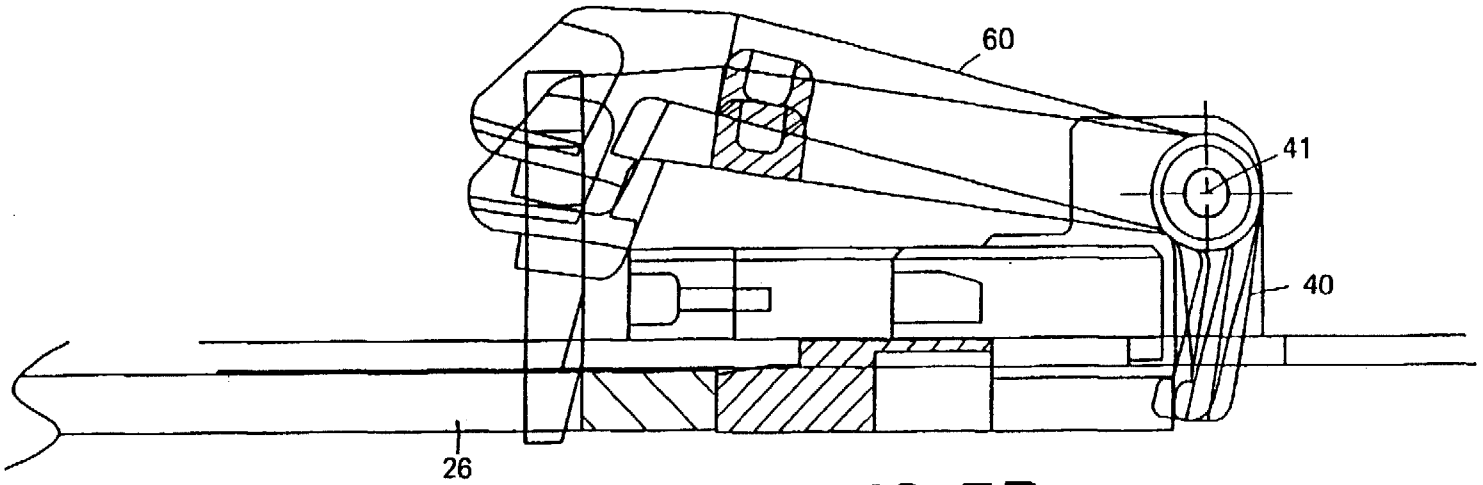
Figure 7A:
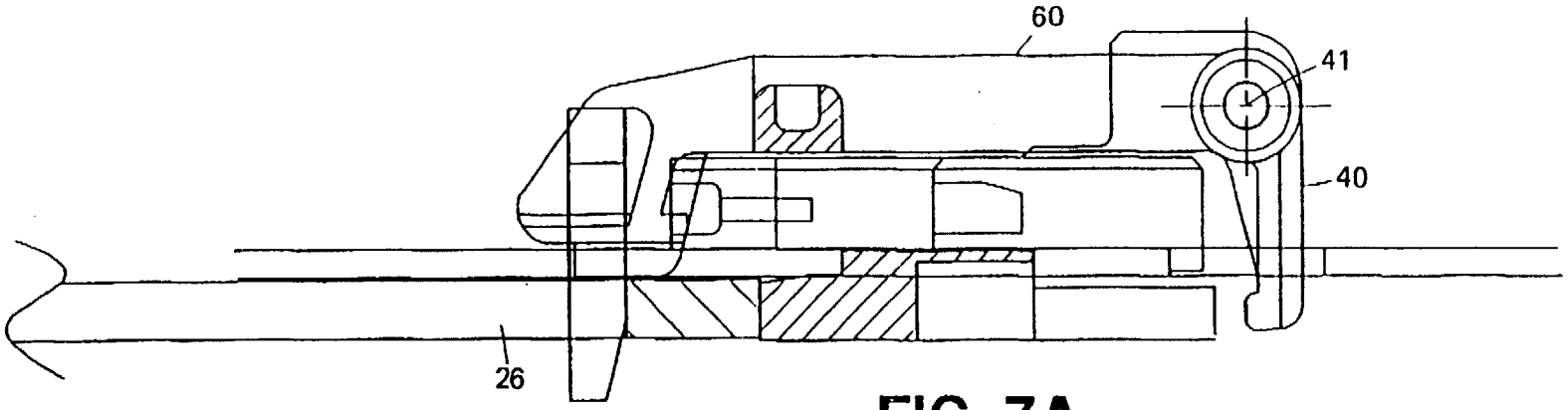

FIGS. 4*a* to 4*d* are cross-sectional side views of the buckle mechanism of FIG. 1 illustrating tongue insertion;

FIGS. 5*a* to 5*e* illustrate tongue withdrawal;

FIGS. 6*a* to 6*c* illustrate the effects of pretensioning on the buckle mechanism of the invention;

FIGS. 7*a* and 7*b* are side views of an alternative embodiment of the invention; and FIGS. 8*a* to 8*e* illustrate the operation of the embodiment of FIGS. 7*a* and 7*b*.

Throughout the Figures, like parts are identified by like reference numbers.

Figure 2:
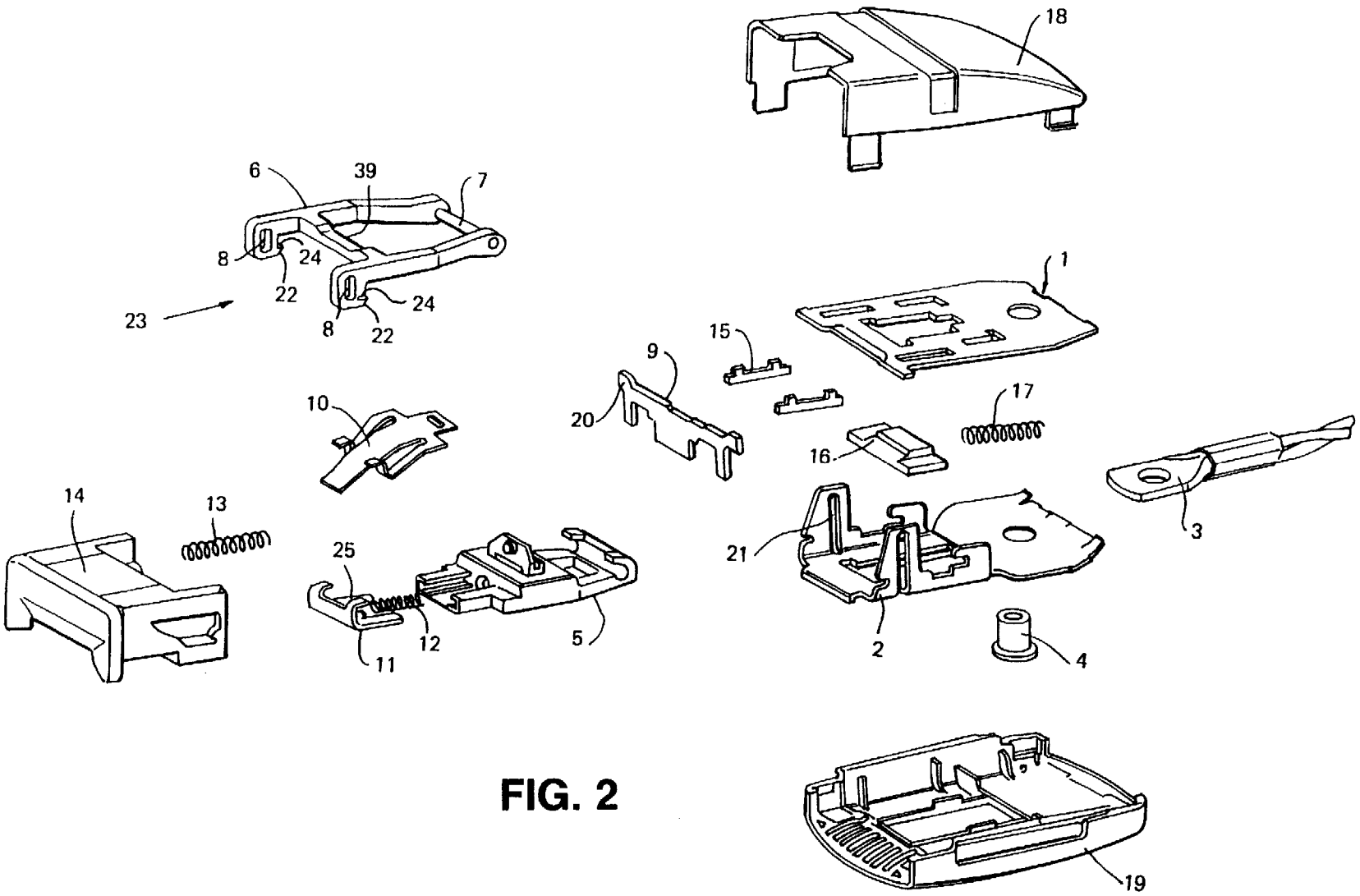
FIG. 2 is an exploded view of the mechanism of FIG. 1.

Referring to FIGS. 1 and 2, the buckle mechanism comprises an upper frame 1 and a lower frame 2. The fastening plate 3 is connected by strong cables to a secure part of a vehicle, optionally via a pretensioning device (not shown) to remove belt slack at the buckle end, in the event of a crash situation.

Housing 5 is supported on the upper frame 1, and a rocker 6 is mounted on the housing 5 at one end to pivot about rocker pivot bar 7. The other end of rocker 6 has mutually spaced arms each with holes 8 at their ends for receiving projections 20 on a lockbar 9 so as to carry the lockbar 9 in a general direction perpendicular to the plane of path of insertion of the tongue in response to a pivoting action of the rocker 6. The projections 20 of lockbar 9 slide in slots 21 in the lower frame 2.

There are projections 22 on the arms 8 of rocker 6 of a generally triangular form extending in the direction of tongue insertion (indicated by arrow 23). It will be seen that such abutments provide abutment surfaces 24 generally parallel to the direction of tongue insertion.

These abutment surfaces 24 cooperate with abutments on the button to prevent the pivoting action of the rocker 6 thus preventing spurious release of the tongue in the event of shock when the buckle is in use to restrain a vehicle occupant.

An overlock plate 11 has a hook 25 which is arranged so that it overlocks a bar 39 of rocker 6 when the overlock plate 11 slides in the direction of arrow 23 against the action of spring 12, again preventing spurious release of the buckle in certain circumstances, particularly in the event of inertial forces on the buckle mechanism in the direction of the arrow 23. This is described further below.

The lockbar 9 is biased into engagement with the tongue by a lockbar spring 10 in the form of a three pronged leaf spring. The overlock plate 11 is mounted via a calibration or interlock sensor spring 12 to the housing 5 and slides in slots (shown in FIG. 2) parallel to the direction of tongue insertion.

A button spring is shown at 13 provides a resilient action for release button 14 and to return it to its null position.

Packing bars 15 are incorporated in this particular embodiment. These packing bars 15 allow production of a standard mechanism that will accomodate various widths of tongue. Traditionally separate frames have been necessary to accommodate different tongue widths (there are at least two "standard" widths in use at present). Although not shown as such in the figure, the packing bars 15 could be integrally moulded with the ejector so that when assembled the first operation, i.e. tongue insertion, would separate the ejector.

The use of packing bars, either integral with the ejector or separate is a considerable advantage for volume production.

An ejector 16 biased in the tongue disengaging direction by ejector spring 17 is mounted within the buckle to impart some force to eject the tongue on its release from the buckle mechanism.

Upper cover 18 and lower cover 19 (shown in FIG. 2) made of plastics material protect the parts of the buckle mechanism, from ingress by dirt, water or mechanical interference.

Figure 3:
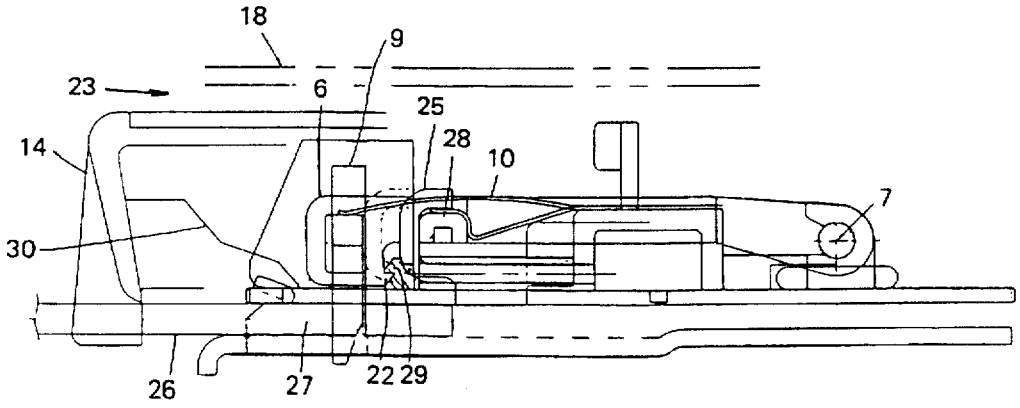
FIG. 3 is a cross-sectional view of the mechanism of FIG. 1.

FIG. 3 shows a cross-sectional view of the buckle mechanism. The upper cover 18 is indicated as is button 14. A belt tongue 26 is inserted in the direction of arrow 23 in a guide channel in the buckle mechanism and lockbar 9 engages a slot 27 in the tongue to engage the buckle. The lockbar 9 is biased into the buckle engaging position (shown in FIG. 3) by three pronged leaf spring 10 resting against both the intermediate bar 28 of rocker 6 and the lockbar 9.

The cooperating abutments 22 and 29 are shown clearly in cross-section as is the interaction of hook 25 on overlock plate 11 with the intermediate bar 28 of rocker 6 to prevent spurious disengagement of the buckle mechanism.

In FIG. 3 will also be clearly seen a ramp surface 30 of button 14 which on depression of the button in the direction 23 displaces the lockbar 9 out of engagement with the tongue 26 to release the tongue. The ramp 30 has three areas of different gradient as shown in FIG. 3. The leading edge of the ramp is at a gradient of around 40°–60°, preferably 50°. The middle portion has a gradient of 15°–25° and preferably around 20° while the trailing part of the ramp surface 30, has a gradient similar to the leading edge, i.e. around 50°.

The operation of the buckle will now be described with reference to FIGS. 4 to 6.

Figure 4A:
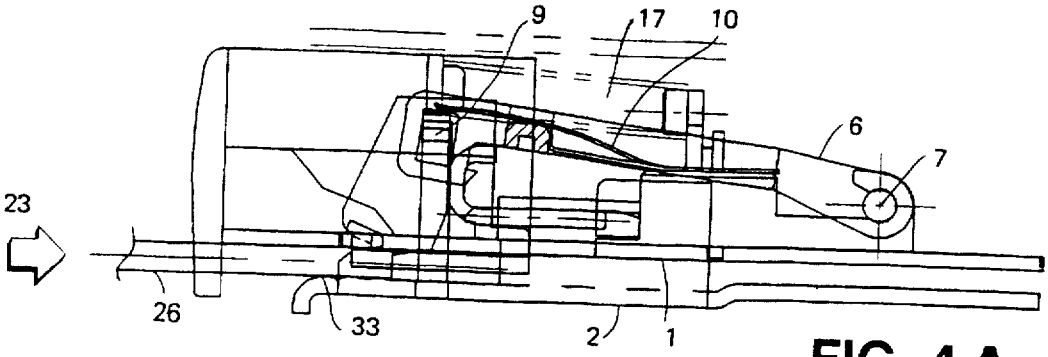
Figure 4B:
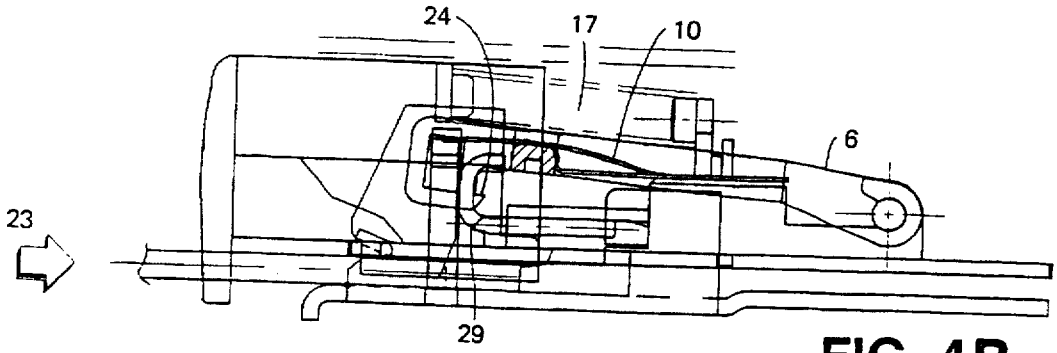
Figure 4C:
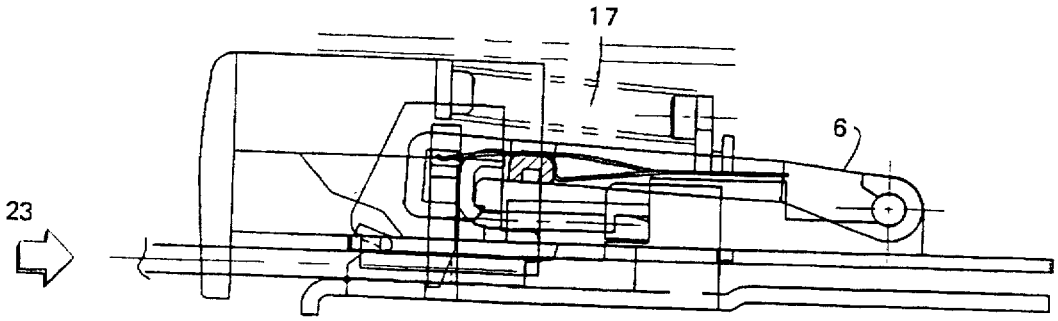
Figure 4D:
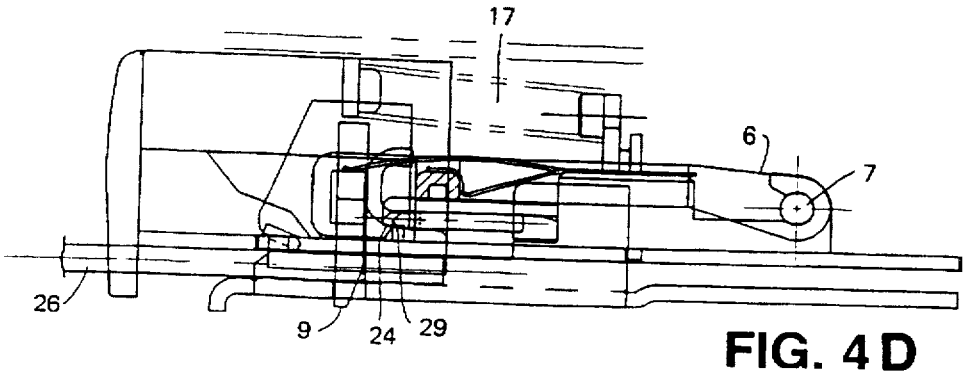

FIGS. 4*a* to 4*d* illustrate in sequence the process of inserting a tongue into the buckle mechanism. The tongue 26 is inserted in the direction of the arrow 23 into guide channel 33 of the buckle (formed by upper and lower frames 1 and 2). The lockbar 9 is at this stage lifted clear of the guide channel 33 because rocker 6 is titled upwards (as viewed in FIG. 4*a*). As the tongue is inserted further into guide channel 33 the lockbar 9 descends into slot 27 in the tongue under the force of the three pronged spring 10. In FIG. 4*d* the tongue is shown fully inserted with lockbar 9 engaging through the slot 27 in the tongue. The abutments surfaces 24 on the arms of the rocker 6 now engages abutment surface 29 on the button 14 to prevent spurious disengagement of the buckle.

The release of the buckle mechanism is shown in FIGS. 5*a* to 5*e*.

Figure 5A:
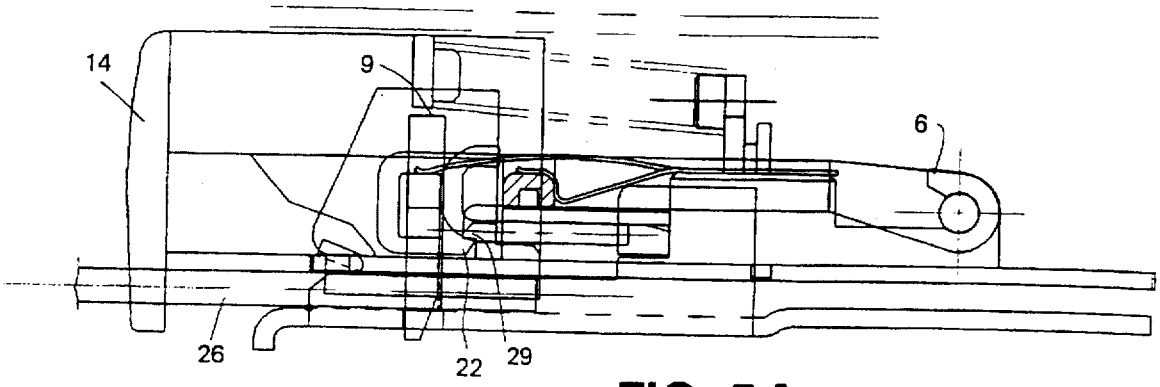

In FIG. 5*a* the locked position is shown wherein the lockbar 9 engages the slot 27 in the tongue 26 and the abutment projections 22 on the arms of the rocker 6 engage the projections 29 on the button 14.

Figure 5B:
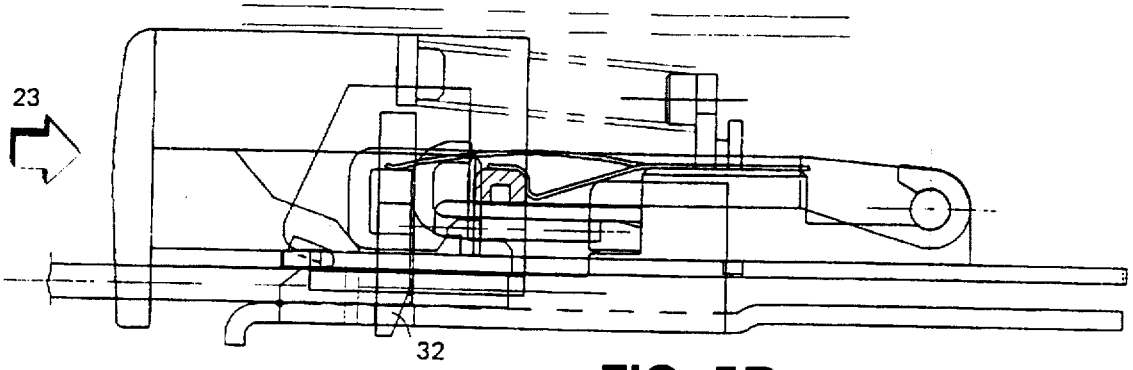

In FIG. 5*b* the button 14 begins to move in the direction of arrow 23 (tongue insertion direction). It moves approximately 1 mm before the leading edge of the ramp surface 30 contacts the rocker 6. The ramp 30 causes rocker 6 to pivot lifting the lockbar 9 against the action of the leaf spring 10.

Figure 5C:
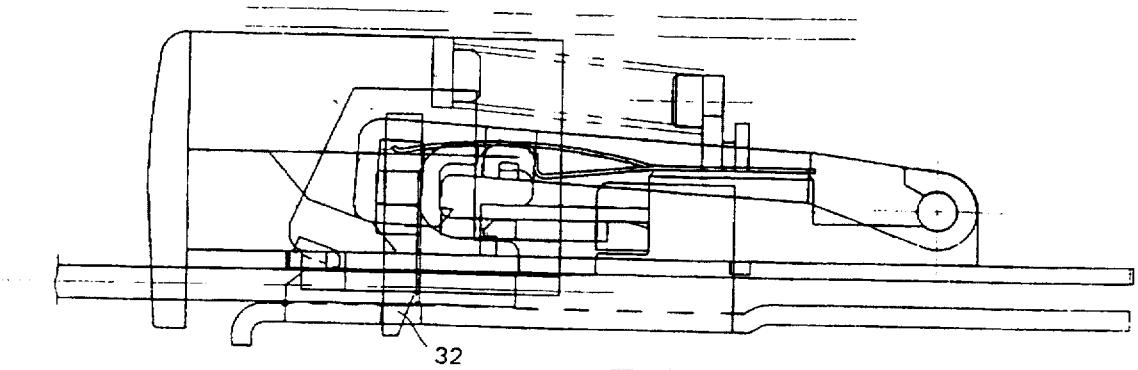

In FIG. 5*c* the button 14 has moved approximately 3 mm and just started to lift the rocker 6. During this 3 mm movement there is a last motion between the rocker 6 and the lock plate 9 such that the rocker 6 lifts but does not move the lockplate 9. During this "lost motion" the leaf spring 10 on the lockplate 9 is lifted off the lockplate 9 due to being contacted by the cross rail of the rocker, with the result that the lock plate 9 is left in a condition whereby the only forces acting upon it are due to the tongue engagement and button being pressed in the direction of release.

Figure 5D:
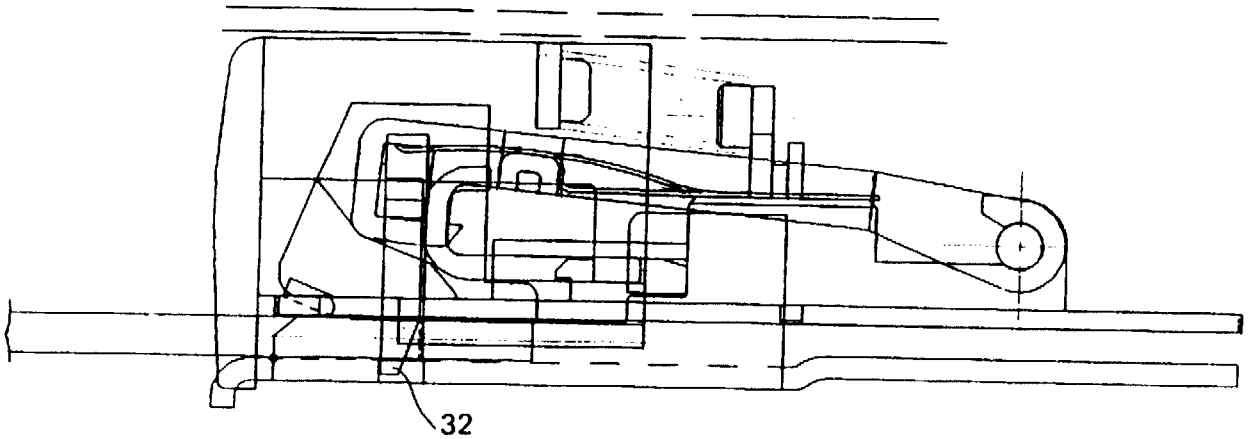
Figure 5E:
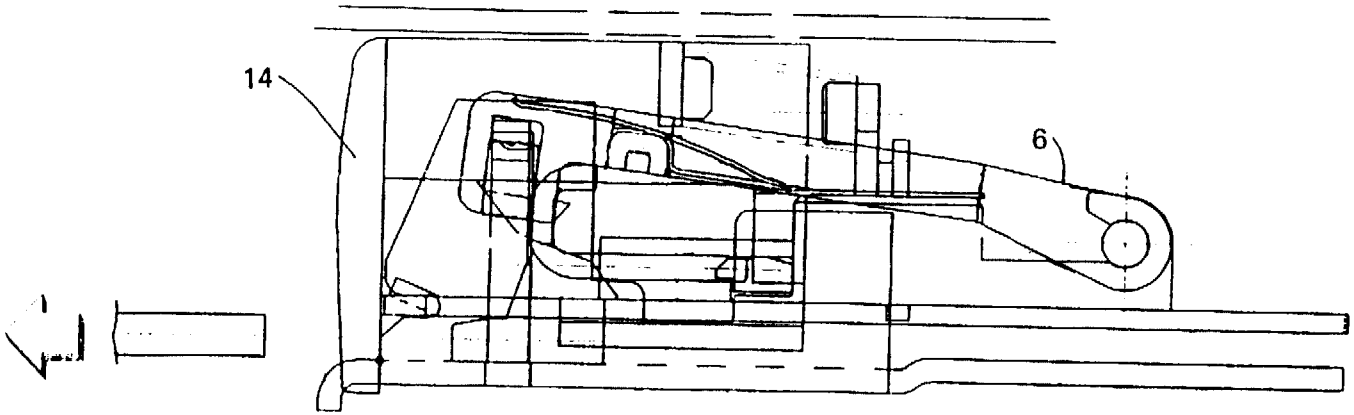

In FIG. 5*d* the rocker 6 and lockplate 9 have been lifted to the release position and the ramp surface 32 on lockbar 9 is beginning to contact an edge of the slot 27 in the tongue 26. This ramp surface on lockplate 9 encourages release of the tongue. Full release of the tongue is shown in FIG. 5*e* where the tongue is ejected by ejector 16 biased by spring 17 (FIG. 2). The leaf spring 10 and rocker 6 are reset on the lockplate ready for tongue re-insertion.

In FIGS. 6*a*–6*c* the operation of the buckle is illustrated in the event of a shock, for example caused by pretensioning the buckle in a crash situation.

In FIG. 6*a*, the buckle mechanism is pulled by a pretensioner in the direction of arrow 33 to take up excess slack in the system. Forces of up to 6,000 g can be generated by this pretensioning which may be done by a mechanical, spring pretensioner, or by a pyrotechnic pretensioner. Spurious release of the buckle during this operation is prevented by the cooperating abutments on the rocker 6 and the button 14, since the rocker is prevented by the cooperation of these abutments from pivoting about the axis 7 and thus lockbar 9 is maintained securely in the slot 27 of tongue 26.

However, in FIG. 6*b* on completion of the pretensioning operation, the inertia of button 14 causes it to continue moving even when the buckle housing has stopped moving. This is indicated by the dotted line in FIG. 6*b*. This movement causes a separation of the abutment surfaces 24 and 29. However, the inertia also causes hook 25 on overlocker plate 11 to move in the same direction as button 14 against the action of the spring 12, so as to overlock the intermediate bar 28 of rocker 6 and again prevent spurious pivoting of the rocker and thus prevent spurious release of the buckle mechanism.

In FIG. 6*c* the mechanism has returned to the normal position, the button 14 having rebounded as also has the overlocker plate hook 25. However, the cooperating abutment surfaces 24 and 29 are once again in engagement preventing spurious release.

This buckle mechanism is particularly advantageous as side impact shocks are also prevented from unlocking the buckle spuriously.

FIGS. 7*a* and 7*b* are side views of another embodiment of the invention with an alternative form of rocker 60. In this embodiment the rocker 60 is open fronted which facilitates assembly to the lockplate. Additionally flanges are provided at the front of the rocker to retain the release button, and legs 40 are added to the rear of the rocker to contact the ejector.

FIGS. 8*a* to 8*e* illustrate the operation of the embodiment of FIGS. 7*a* and 7*b*.

Insertion of belt tongue 26 into the buckle mechanism causes the ejector to be displaced to a position in which the lockplate 9 can fall through the aperture in the tongue. If the lockplate 9 does not thus engage, continued movement of the tongue 26 pushes the ejector into contact with the legs 40 of the rocker 60 urging the rocker 60 to pivot about point 41 and biasing the lockplate into engagement in a mechanical forced locking motion.

This embodiment is also particularly advantageous for use with a buckle pretensioner. If the pretensioner fires when the safety belt is slack then the mass of the tongue causes the ejector to bias the rocker 60 in the engagement position with the lockplate and thus to lock the tongue against spurious release in this situation. To reduce the force on the rocker legs in this condition, a stop is provided for the ejector by forming at least one leg extending down from the upper frame to interlock with the lower frame of the buckle.

Figure 8A:
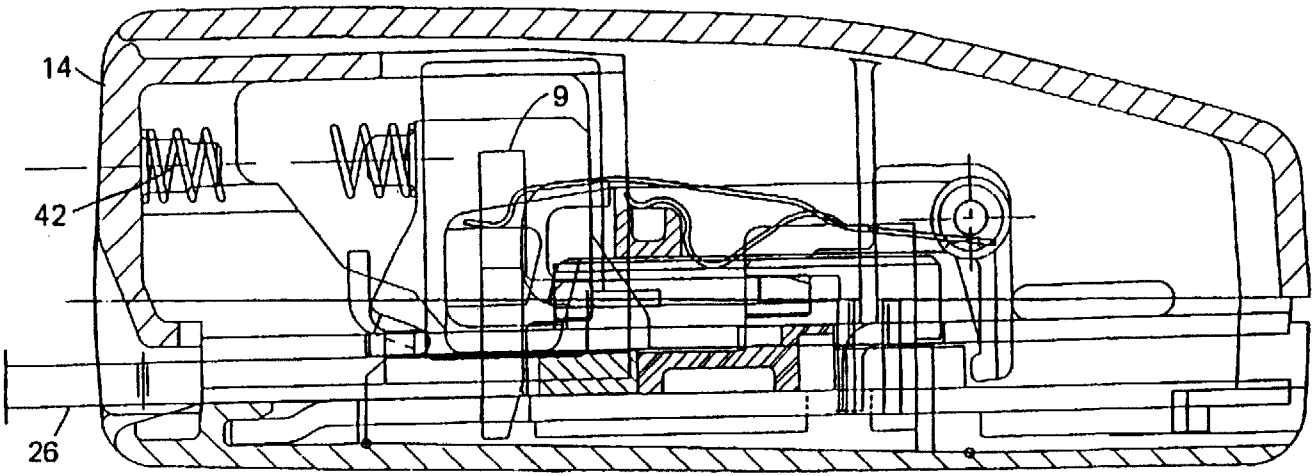

The operation of this embodiment will be evident from FIGS. 8*a* to 8*e* in comparison with FIG. 5*a* to 5*e* as described above. In FIG. 8*a* the buckle release button 14 is in the buckle retaining, normal, position and the tongue 26 is retained by lockplate 9 engaging though the aperture in the tongue 26.

Figure 8B:
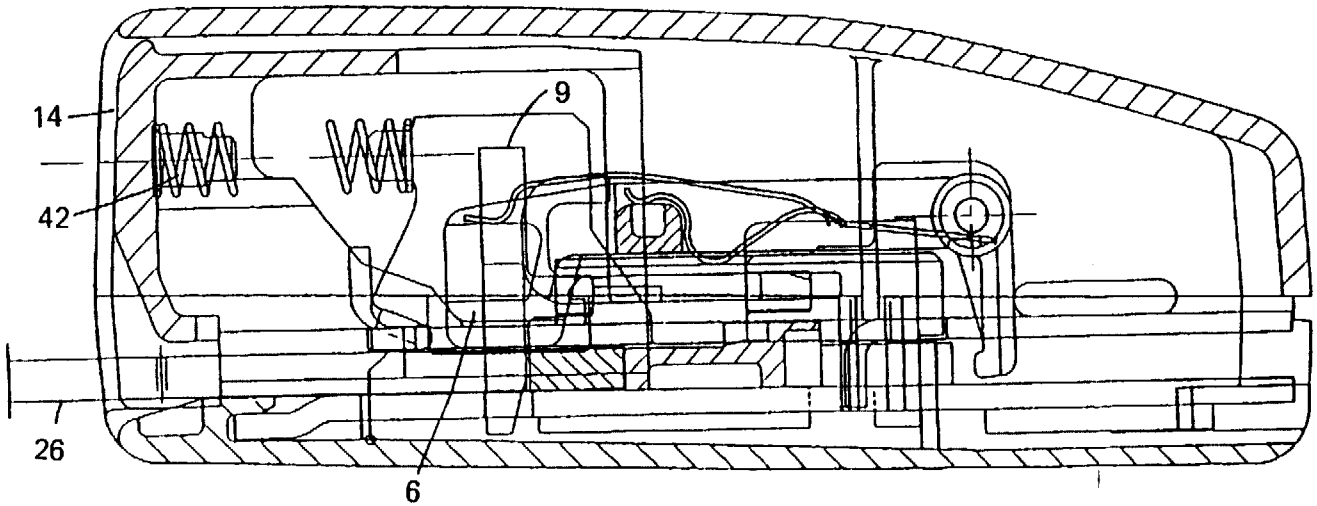
Figure 8C:
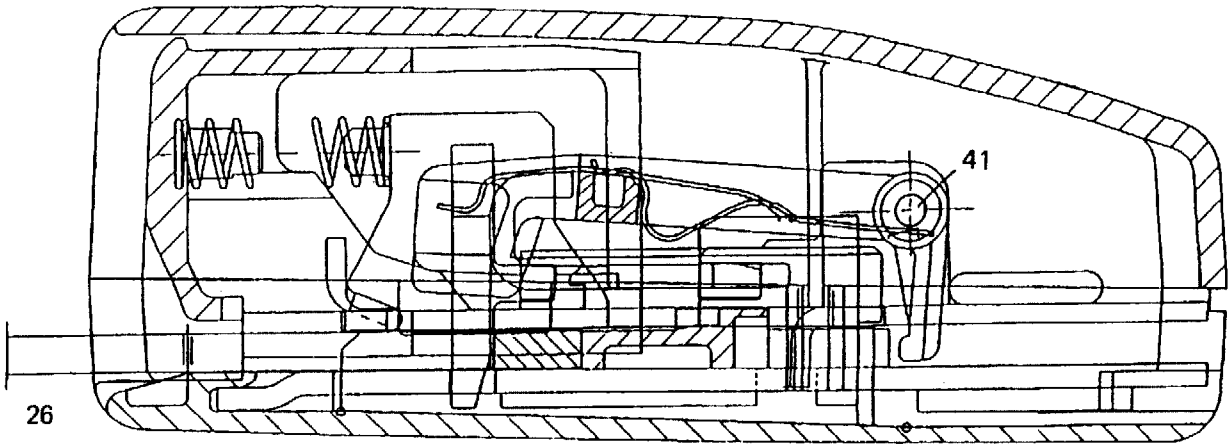
Figure 8D:
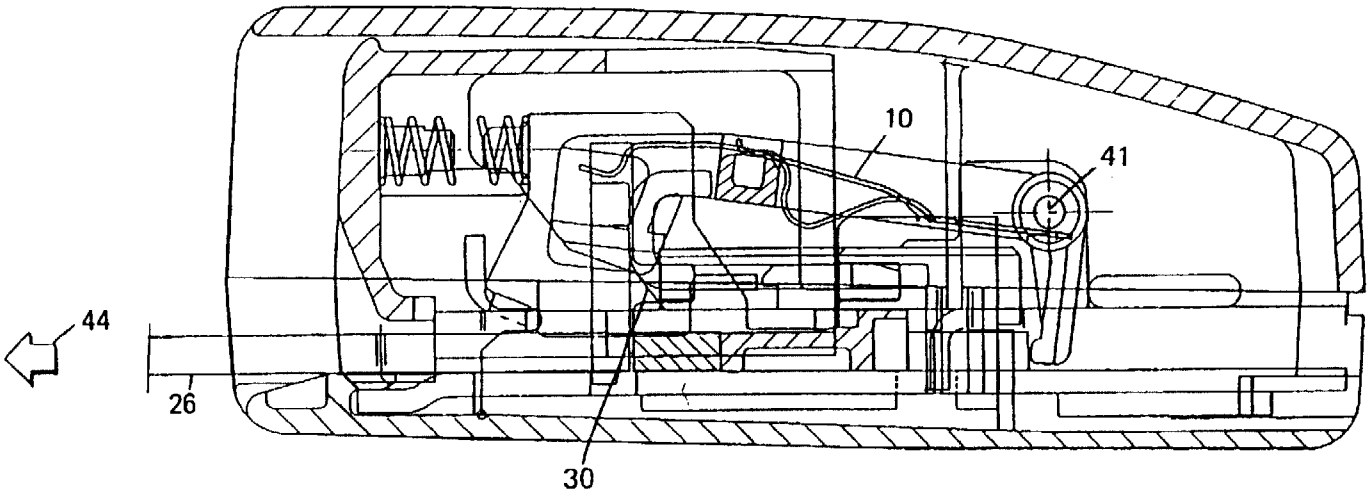
Figure 8E:
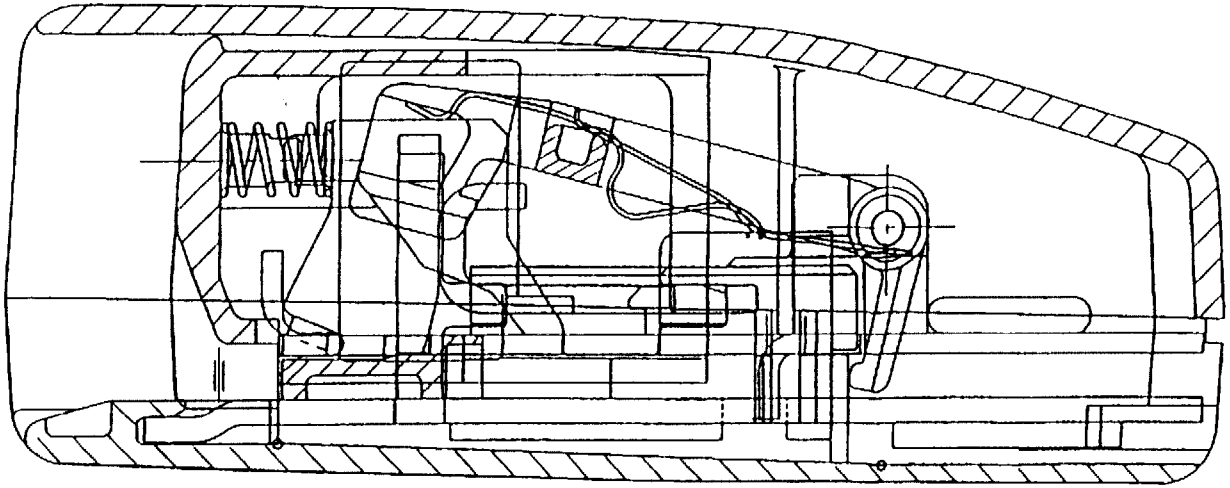

In FIG. 8*b* the button 14 is shown depressed by approximately 1 mm against the biasing action of button spring 42. At this point the slack in the system is being taken up and the clearance between the lockplate 9 and the tongue engaging surface indicated by X in FIG. 8*a* is reduced such that the leading edge of button ramp surface 30 begins to contact rocker 6. In FIG. 8*c* the button 14 is depressed approximately 3–4 mm at which stage all the lost motion is taken up and the rocker 6 begins to pivot about pivot point 41 against the retaining action of leaf spring 10. In FIG. 8*d*, with the button 14 depressed around 7 mm, the tongue is released and forced by the ejector out of the buckle housing in the direction of arrow 44. In FIG. 8*e*, the tongue is completely removed from the buckle housing.

We claim:

1. A buckle mechanism comprising a movable button member and locking means movable transversely to the plane of movement of the button to engage or disengage a locking surface of a co-operating tongue wherein mutually co-operating abutments are provided respectively on the button member and on the locking means to lock the buckle against transverse forces tending to move the locking means to a position of disengagement wherein the locking means is resiliently biased into locking engagement with the tongue, and wherein the locking means comprises a locking member constrained to move in a plane transverse to the plane of the tongue insertion path, which locking member is guided by a rocking support member, wherein one of the abutments is provided on the rocking support member, the buckle mechanism further comprising an inertial overlocking member independent of the tongue, resiliently biased in the tongue withdrawal direction and slidably mounted in a plane spaced from the tongue insertion path and adapted to overcome the resilient bias under the action of inertia forces in the plane of the tongue insertion path, the inertial overlocking member having at least one overlocking surface to block movement of the locking member against the action of inertia forces so as to prevent the locking member moving out of engagement with the tongue under inertial forces.

2. A buckle mechanism according to claim 1, wherein the button member is operatively coupled to a ramp surface, the movement of which ramp surface effects disengagement of the buckle, and wherein the leading surface of the ramp member in the buckle disengagement direction has a gradient of between 40° and 60° relative to the plane of the co-operating tongue.

3. A buckle mechanism according to claim 2, wherein the gradient is between 45° and 55°.

4. A buckle mechanism according to claim 3, wherein the gradient is substantially around 50°.

5. A buckle mechanism according to claim 2, wherein the ramp surface comprises a second part having a gradient of between 15° and 25° to the plane of the tongue and being downstream of the first part in the direction of button movement for buckle disengagement.

6. A buckle mechanism according to claim 5, wherein the ramp surface comprises a third part having a gradient of between 40° and 60° relative to the plane of the tongue and being downstream of the second part.

7. A buckle mechanism according to claim 6, wherein the third part of the ramp surface has a gradient of around 50°.

8. A buckle mechanism according to claim 2, wherein the leading edge of the button ramp does not abut the locking member in the normal button stage.

9. A buckle mechanism according to claim 1, wherein the locking means is resiliently biased into locking engagement with the tongue by means of a leaf spring.

10. A buckle mechanism according to claim 9, wherein the leaf spring is a three-pronged leaf spring.

11. A buckle mechanism according to claim 1, wherein the resilient strength of the means biasing the locking member into engagement with the tongue is substantially equal to the resilient force of an ejector spring which is arranged to urge the tongue in a buckle disengagement direction when the tongue is released.

12. A buckle mechanism according to claim 1 wherein the rocking support member is arranged in a plane spaced from the tongue insertion plane so disposed to the centre of gravity of the buckle mechanism so as to balance the inertial effects of the buckle components.

13. A buckle mechanism according to claim 1 further comprising packing members arranged within a tongue insertion channel so as to adapt the width of the tongue insertion channel to a particular tongue width.

14. A buckle mechanism according to claim 13, wherein the packing members are integrally moulded with an ejector member for the tongue.

15. A buckle mechanism according to claim 1, wherein the abutment on the locking means is provided by a projection of a generally triangular form extending in a direction of tongue insertion to provide a first abutment surface generally parallel to the direction of tongue insertion, and the abutment on the button member is provided by a projection of a generally triangular form extending in a direction of tongue ejection to provide an opposing abutment surface for co-operation with the first abutment surface.

16. A buckle mechanism according to claim 1 wherein the locking means is slidably movable transverse to the plane of movement of the button.

* * * * *